US010160130B2

(12) United States Patent
Tryczak

(10) Patent No.: US 10,160,130 B2
(45) Date of Patent: Dec. 25, 2018

(54) CUTTING BOARD ASSEMBLY

(71) Applicant: Kenneth Tryczak, Norfolk, VA (US)

(72) Inventor: Kenneth Tryczak, Norfolk, VA (US)

( * ) Notice: Subject to any disclaimer, the term of this patent is extended or adjusted under 35 U.S.C. 154(b) by 0 days.

(21) Appl. No.: 15/604,109

(22) Filed: May 24, 2017

(65) Prior Publication Data

US 2018/0339417 A1 Nov. 29, 2018

(51) Int. Cl.
*B26D 3/26* (2006.01)
*B26D 7/20* (2006.01)

(52) U.S. Cl.
CPC ..... *B26D 3/26* (2013.01); *B26D 7/20* (2013.01)

(58) Field of Classification Search
CPC ..... B26D 3/26; B26D 7/20
USPC ..... 30/114, 123; 269/54.4, 54.5, 292, 293, 269/294
See application file for complete search history.

(56) References Cited

U.S. PATENT DOCUMENTS 328,995 A * 10/1885 Andrews
1,962,737 A * 6/1934 Gutmann ..... B26D 3/185 30/173
D162,101 S * 2/1951 Wells ..... D7/683
2,824,588 A * 2/1958 Lyon ..... B26D 3/26 30/114
3,060,838 A * 10/1962 Nick ..... A21C 15/04 30/114
3,146,815 A * 9/1964 Cirese ..... A47J 47/005 269/302
3,995,844 A 12/1976 Hellman
4,580,343 A * 4/1986 Bell, Jr. ..... B26B 29/063 269/3
D312,740 S 12/1990 Greenhut et al.
5,527,022 A 6/1996 Gibson
5,580,037 A 12/1996 Gore
5,664,474 A 9/1997 Punt
5,842,689 A * 12/1998 Hunter ..... A47J 47/005 269/54.5
7,086,155 B2 * 8/2006 Chan ..... A47J 9/005 30/114
D543,802 S 6/2007 Fuchs
D657,209 S * 4/2012 Getzinger ..... D7/361
D687,267 S * 8/2013 Harris ..... D7/673
9,630,334 B2 * 4/2017 Garcia ..... B26D 3/245
2006/0254058 A1 * 11/2006 Chang ..... B26D 3/26 30/114
2009/0282990 A1 11/2009 Farnum et al.
2013/0036882 A1 * 2/2013 Getzinger ..... B26B 3/04 83/23
2016/0031107 A1 2/2016 Farid
2016/0039107 A1 * 2/2016 Varanasi ..... B26D 3/185 83/599

* cited by examiner

*Primary Examiner* — Hwei C Payer

(57) ABSTRACT

A cutting board assembly for slicing a food item includes a food slicer that may be manipulated thereby facilitating the food slicer to slice a food item into a plurality of slices. A plate is provided and the plate is selectively positioned on a support surface. A plurality of pegs is provided and each of the pegs is coupled to and extends upwardly from the plate. A food item is selectively placed on each of the pegs. Moreover, the plurality of pegs space the food item from the plate thereby facilitating the food slicer to slice fully through the food item.

3 Claims, 3 Drawing Sheets

CUTTING BOARD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cutting devices and more particularly pertains to a new cutting device for slicing a food item.

BRIEF SUMMARY OF THE INVENTION

An embodiment of the disclosure meets the needs presented above by generally comprising a food slicer that may be manipulated thereby facilitating the food slicer to slice a food item into a plurality of slices. A plate is provided and the plate is selectively positioned on a support surface. A plurality of pegs is provided and each of the pegs is coupled to and extends upwardly from the plate. A food item is selectively placed on each of the pegs. Moreover, the plurality of pegs space the food item from the plate thereby facilitating the food slicer to slice fully through the food item.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
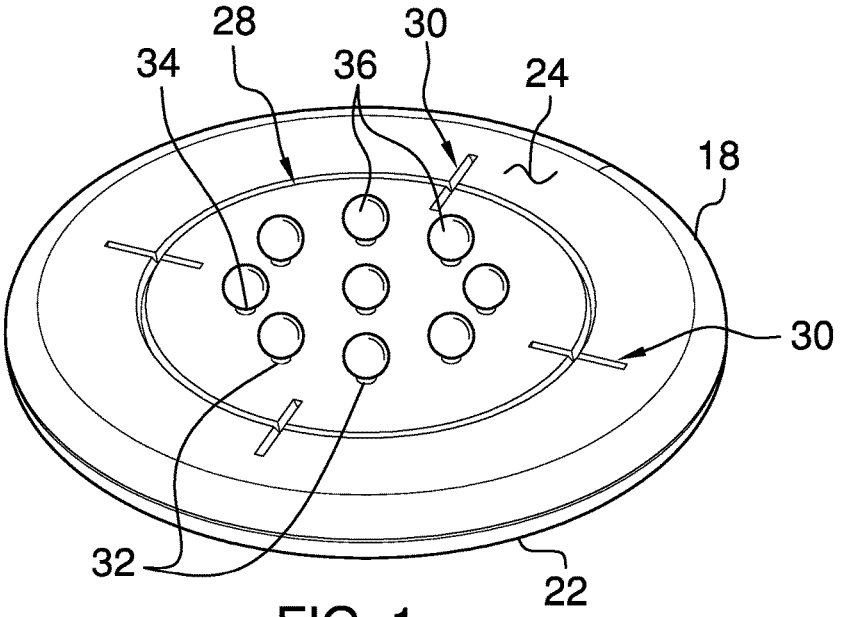
FIG. 1 is a top perspective view of a cutting board assembly according to an embodiment of the disclosure.
Figure 2:
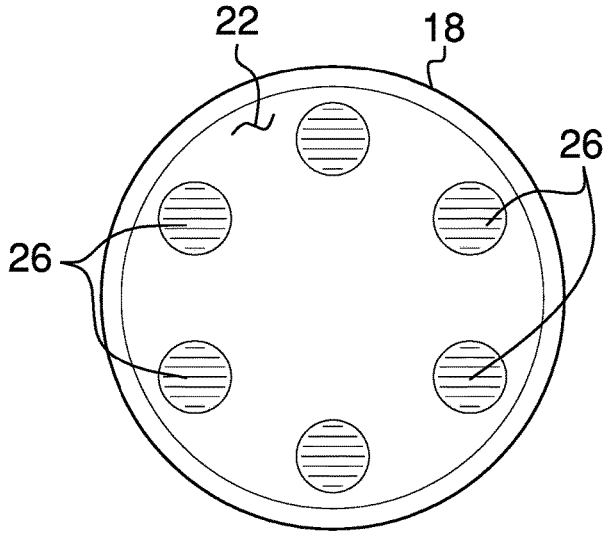
FIG. 2 is a bottom view of an embodiment of the disclosure.
Figure 3:
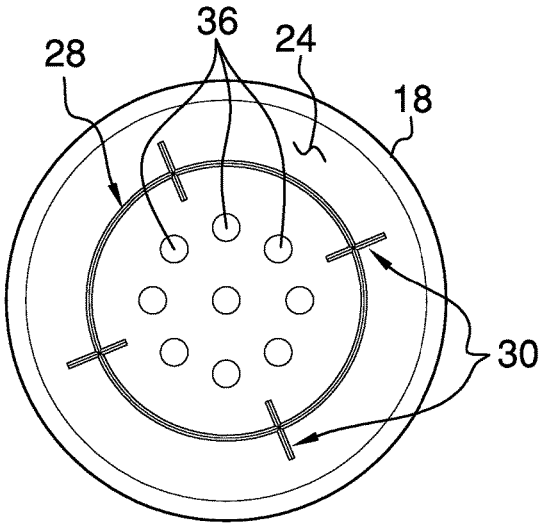
FIG. 3 is a top view of an embodiment of the disclosure.
Figure 4:
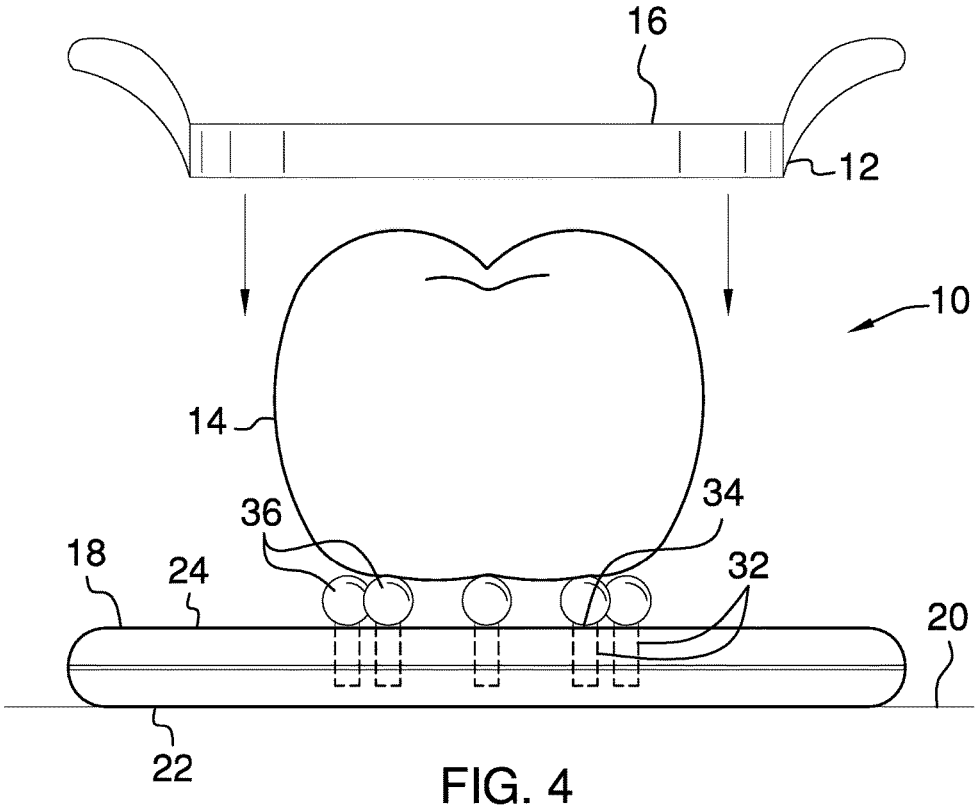
FIG. 4 is a right side phantom view of an embodiment of the disclosure.

With reference now to the drawings, and in particular to FIGS. 1 through 6 thereof, a new cutting device embodying the principles and concepts of an embodiment of the disclosure and generally designated by the reference numeral 10 will be described.

As best illustrated in FIGS. 1 through 6, the cutting board assembly 10 generally comprises a food slicer 12 that may be manipulated to slice a food item 14 into a plurality of slices. The food slicer 12 includes at least one blade 16. Moreover, the food slicer 12 may be a commercially manufactured slicer of any conventional design to include, but not be limited to, knives, apple slicers, fruit slicers and any other type of food slicers and fruit slicers.

A plate 18 is provided and the plate 18 is selectively positioned on a support surface 20 such as a table top or the like. The plate 18 has a first surface 22 and a second surface 24 and a plurality of pads 26 is coupled to the first surface 22. Each of the pads 26 is comprised of a resiliently compressible material to frictionally engage the support surface 20. In this way the plate 18 is inhibited from sliding on the support surface 20 when the food item 14 is cut.

The second surface 24 has a first groove 28 extending downwardly toward the first surface 22. The first groove 28 is continuous such that the first groove 28 forms a circle and the first groove 28 is centrally positioned on the second surface 24. The second surface 24 has a plurality of second grooves 30 each extending toward the first surface 22. Each of the second grooves 30 intersects the first groove 28. The second grooves 30 are spaced apart from each other and are distributed around the first groove 28.

A plurality of pegs 32 is provided and each of the pegs 32 is coupled to and extends upwardly from the plate 18. Additionally, the food item 14 is positioned on each of the pegs 32 to space the food item 14 from the plate 18. In this way the food slicer 12 may slice fully through the food item 14. The food item 14 may be a fruit, a vegetable, meat and any other food item 14.

Each of the pegs 32 is positioned on the second surface 24 and each of the pegs 32 has a distal end 34 with respect to the second surface 24. The second surface 24 may have a plurality of wells and each of the pegs 32 may be positioned in the wells. The first groove 28 receives the at least one blade 16 corresponding to an apple slicer when the apple slicer is urged to slice fully through the food item 14. In this way the at least one blade 16 corresponding to the apple slicer may pass downwardly beyond the second surface 24.

Figure 5:
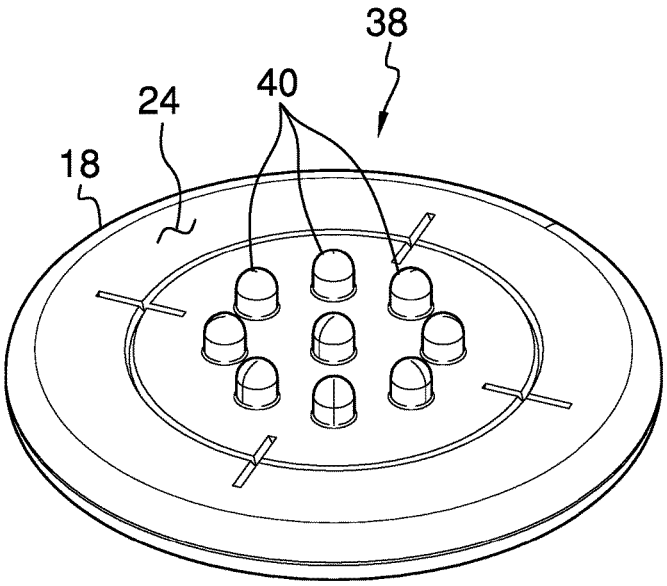
FIG. 5 is a top perspective view of an alternative embodiment of the disclosure.
Figure 6:
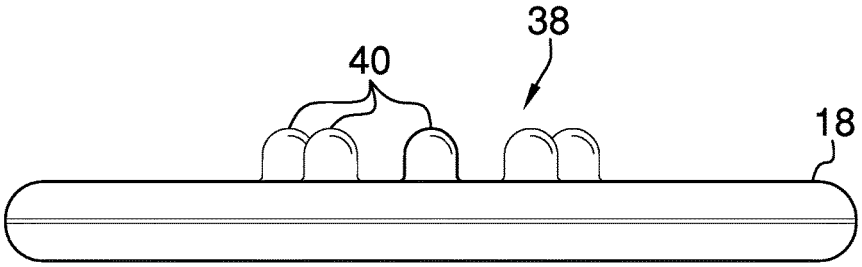
FIG. 6 is a right side view of an alternative embodiment of the disclosure.

A plurality of balls 36 is provided and each of the balls 36 is positioned on the distal end 34 of an associated one of the pegs 32. Each of the balls 36 inhibits each of the pegs 32 from piercing the food item 14 when the food item 14 is sliced. The plurality of pegs 32 is positioned within the circle formed by the first groove 28. In an alternative embodiment 38 as shown in FIGS. 5 and 6, a plurality of knobs 40 may extend upwardly from the second surface 24 of the plate 18. The knobs 40 may be spaced apart from each other and be distributed within the circle formed by the first groove 28. The food item 14 may be positioned on the knobs 40 to space the food item 14 from the plate 18.

In use, the plate 18 is positioned on the support surface 20 and the food item 14 is placed on the balls 36. In this way the food item 14 is spaced from the plate 18. The food slicer 12 is urged downwardly through the food item 14 to slice the food item 14. Additionally, the pegs 32 facilitate the food slicer 12 to pass fully through the food item 14 when the food item 14 is sliced. In this way the food slicer 12 is inhibited from cutting fingers and hands when the food item 14 is sliced.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cutting board assembly being configured to lift a food item for cutting, said assembly comprising:

a food slicer being configured to be manipulated thereby facilitating said food slicer to slice the food item into a plurality of slices, said food slicer including at least one blade;

a plate being configured to be positioned on a support surface, said plate having a first surface and a second surface, said second surface having a first groove extending downwardly toward said first surface, said first groove being continuous such that said first groove forms a circle, said first groove being centrally positioned on said second surface;

a plurality of pegs, each of said pegs being coupled to and extending upwardly from said plate wherein each of said pegs is configured to have the food item positioned thereon, said plurality of pegs being configured to space the food item from said plate thereby facilitating said food slicer to slice fully through the food item, each of said pegs being positioned on said second surface, each of said pegs having a distal end with respect to said second surface, said first groove receiving said at least one blade when said food slicer is urged to slice fully through the food item thereby facilitating said at least one blade to pass downwardly beyond said second surface; and a plurality of balls, each of said balls being positioned on said distal end of an associated one of said pegs wherein each of said balls is configured to inhibit each of said pegs from piercing the food item when the food item is sliced.

2. The assembly according to claim 1, wherein said second surface has a plurality of second grooves each extending toward said first surface.

3. A cutting board assembly being configured to lift a food item for cutting, said assembly comprising:

a food slicer being configured to be manipulated thereby facilitating said food slicer to slice the food item into a plurality of slices, said food slicer including at least one blade;

a plate being configured to be positioned on a support surface, said plate having a first surface and a second surface, said second surface having a first groove extending downwardly toward said first surface, said first groove being continuous such that said first groove forms a circle, said first groove being centrally positioned on said second surface, said second surface having a plurality of second grooves each extending toward said first surface, each of said second grooves intersecting said first groove, said second grooves being spaced apart from each other and being distributed around said first groove;

a plurality of pegs, each of said pegs being coupled to and extending upwardly from said plate wherein each of said pegs is configured to have the food item positioned thereon, said plurality of pegs being configured to space the food item from said plate thereby facilitating said food slicer to slice fully through the food item, each of said pegs being positioned on said second surface, each of said pegs having a distal end with respect to said second surface, said first groove receiving said at least one blade when said food slicer is urged to slice fully through the food item thereby facilitating said at least one blade to pass downwardly beyond said second surface; and a plurality of balls, each of said balls being positioned on said distal end of an associated one of said pegs wherein each of said balls is configured to inhibit each of said pegs from piercing the food item when the food item is sliced.

* * * * *